United States Patent [19]

Bauer et al.

[11] 4,159,563

[45] Jul. 3, 1979

[54] ELECTRICAL SWITCH CONSTRUCTION AND METHOD OF MAKING THE SAME

[75] Inventors: Werner R. Bauer, Radnor; William N. Smith, Hatboro, both of Pa.

[73] Assignee: Robertshaw Controls Company, Richmond, Va.

[21] Appl. No.: 876,479

[22] Filed: Feb. 9, 1978

Related U.S. Application Data

[62] Division of Ser. No. 707,635, Jul. 22, 1976, Pat. No. 4,109,121.

[51] Int. Cl.[2] ..... H01H 11/00

[52] U.S. Cl. ..... 29/622; 200/67 E

[58] Field of Search ..... 29/622, 756; 200/67 D, 200/67 DA, 67 DB, 67 E, 153, 249, 251, 286

[56] References Cited

U.S. PATENT DOCUMENTS

| | | | |
|---|---|---|---|
| 2,490,320 | 12/1949 | Pashby | 29/622 |
| 2,821,588 | 1/1958 | Fisher | 200/67 E |
| 3,233,055 | 2/1966 | Russell | 200/67 DA |
| 3,846,600 | 11/1974 | Kolze et al. | 200/251 |
| 3,989,914 | 11/1976 | Stearley et al. | 200/67 D |
| 4,010,337 | 3/1977 | Thompson et al. | 200/67 D |

*Primary Examiner*—Michael J. Keenan

*Attorney, Agent, or Firm*—Candor, Candor & Tassone

[57] ABSTRACT

A double throw electrical switch construction having a housing carrying a movable actuator unit for moving a snap switch blade of the housing over center to snap a contact portion of the blade between a pair of spaced contact stops carried by the housing with a contact force being sustained at the "trip point" of the switch construction by an actuator spring of the actuator unit being moved over center before the blade is moved over center by the snap movement of the actuator spring. The actuator unit includes an actuator plunger having lost motion means directly acting against the actuator spring whereby the actuator spring can move relative to the actuator plunger through the lost motion means thereof when the actuator plunger moves the actuator spring over center in either direction thereof.

11 Claims, 15 Drawing Figures

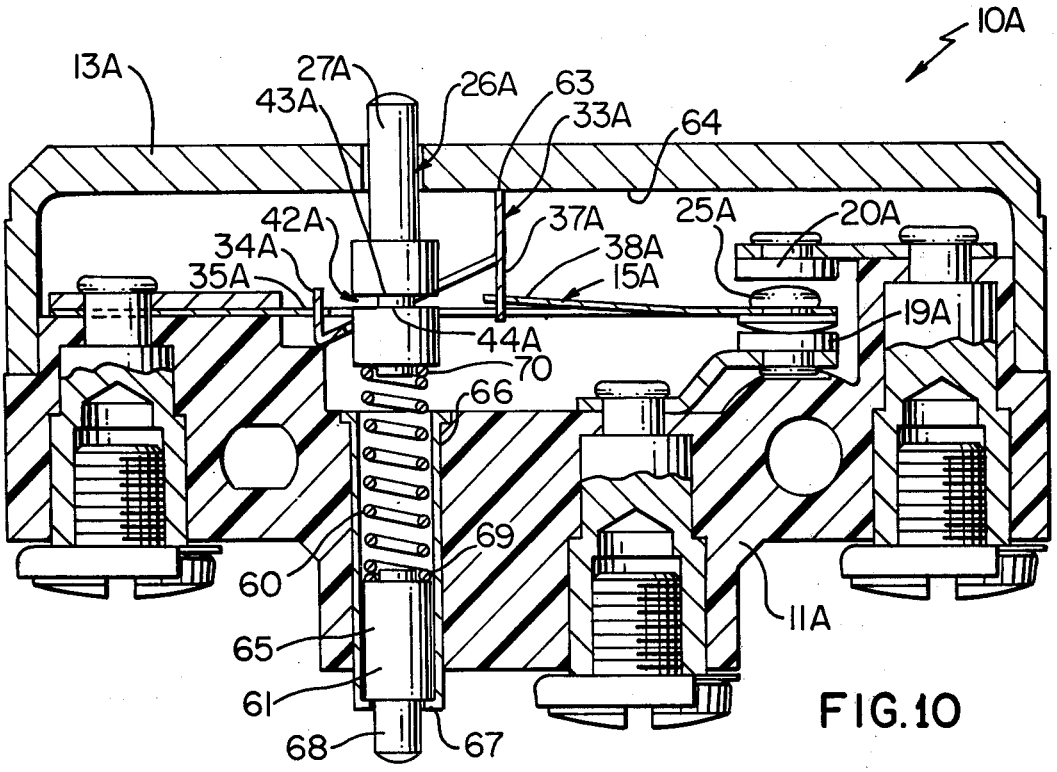
FIG.10
FIG.11
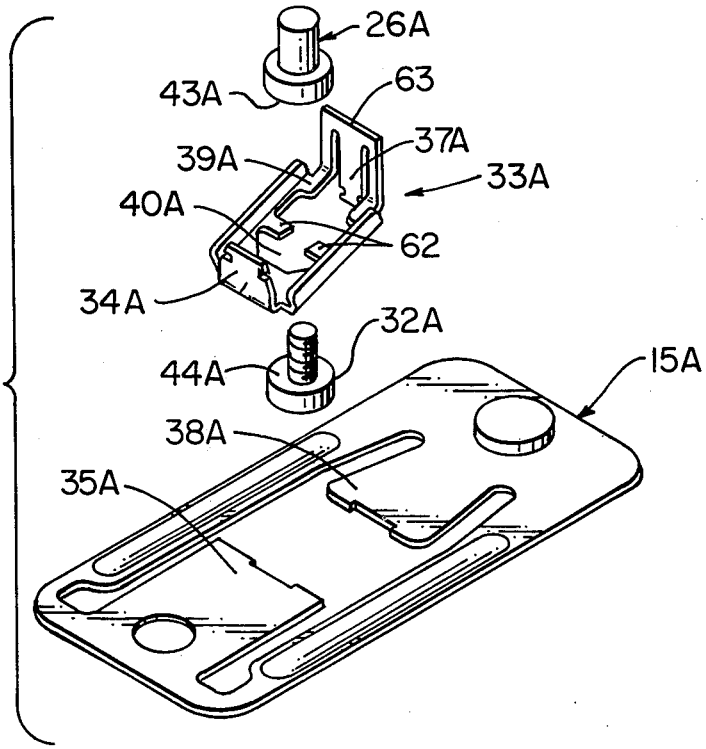

ELECTRICAL SWITCH CONSTRUCTION AND METHOD OF MAKING THE SAME

This application is a divisional application of the copending parent patent application, Ser. No. 707,635, filed July 22, 1976, now U.S. Pat. No. 4,109,121.

This invention relates to an improved double throw electrical switch construction and to a method of making the same.

Most double throw electrical switch constructions are each so constructed and arranged that the switch blade has its contact portion held in contact with either one of a pair of spaced contact stops with a certain biasing force that diminishes quite rapidly to zero before contact transfer occurs so that the slower the switch construction is actuated, the longer the duration of zero contact force which causes a condition which is extremely undesirable for both contact and switch lift. In particular, this condition is the direct function of the contact force as the reduced contact force causes an increase in the resistance offered to current flow between the contacts and because of this increase, tremendously high localized temperature increases occur. This generates a thermoelectric force which is a phenomenom of the discharge that occurs and the gaseous discharge that is produced will start contact surface melting, referred to as a chemical melting loss.

Therefore, a sustainment of contact force through contact transfer is of upmost importance when considering contact and switch longivity.

One such switch construction that sustains contact force through contact transfer is described and illustrated in the copending patent application of Werner R. Bauer, Ser. No. 557,462, filed Mar. 12, 1975, now U.S. Pat. No. 3,967,086. However, it was found that such switch construction, while sustaining contact force through contact transfer, could not be adjusted to have a movement differential of the actuator means thereof smaller than approximately 0.015 of an inch without greatly increasing the actuating force.

Accordingly, it was a feature of this invention to provide an electrical switch construction that matches or lowers existing basic switch operating force differentials while having contact forces inherently higher and a definite sustained amount of contact force through contact transfer.

In particular, one embodiment of this invention provides a double throw electrical switch construction having a housing means carrying movable actuator means for moving a snap switch blade of the housing means over center to snap a contact portion of the blade between a pair of spaced contact stops carried by the housing means with a contact force being sustained at the "trip point" of the switch construction by an actuator spring of the actuator means being moved over center before the blade is moved over center by the snap movement of the actuator spring. The actuator means includes an actuator plunger having lost motion means directly acting against the actuator spring whereby the actuator spring can move relative to the actuator plunger through the lost motion means thereof when the actuator plunger moves the actuator spring over center in either direction thereof. The lost motion means of the plunger can comprise an adjustable air gap of the actuator plunger and thereby provide adjustable means for adjusting the movement differential of the actuator means without adjusting, the air gap between the contact stops as in prior known switch constructions.

Therefore, it is an object of this invention to provide an improved double throw electrical switch construction having one or more of the novel features set forth above or hereinafter shown or described.

Another object of this invention is to provide a method of making such a double throw electrical switch construction, the method of this invention having one or more of the novel features set forth above or hereinafter shown or described.

Other objects, uses and advantages of this invention are apparent from a reading of this description which proceeds with reference to the accompanying drawings forming a part thereof and wherein:

FIG. 10 is a view similar to FIG. 1 and illustrates another electrical switch construction of this invention.

FIG. 11 is a perspective view of the switch blade, actuator spring and actuator plunger of the switch construction of FIG. 10.

Figure 1:
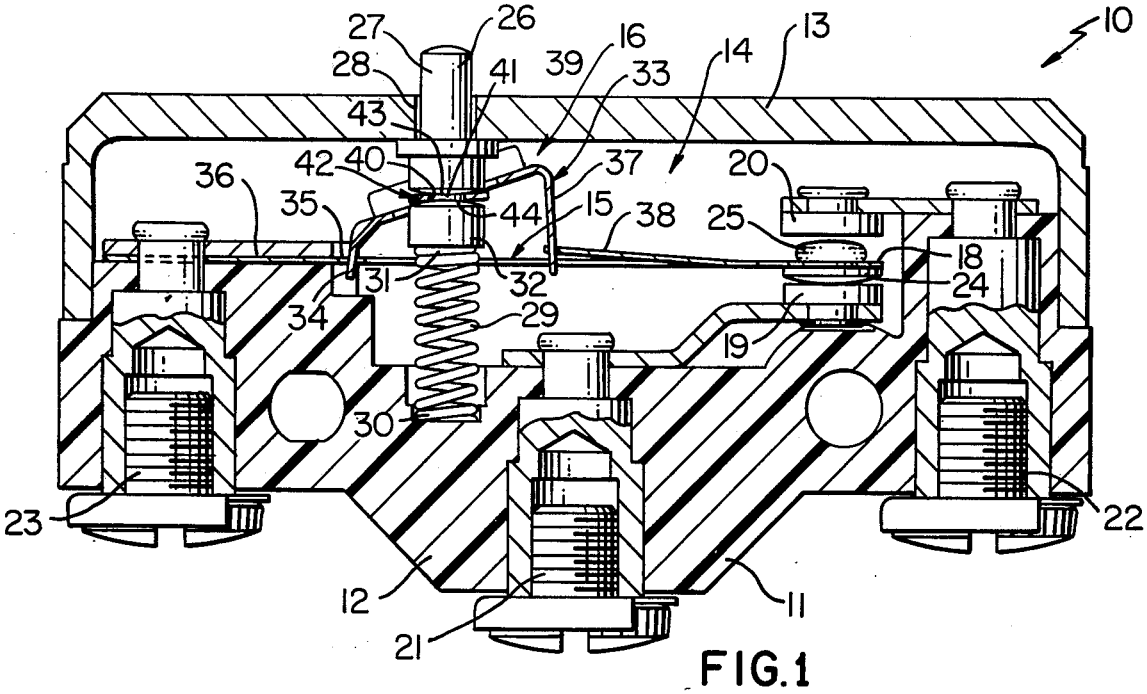
FIG. 1 is a cross-sectional view illustrating the improved electrical switch construction of this invention.

While the various features of this invention are hereinafter described and illustrated as being particularly adapted to provide a double throw electrical switch construction having an application in a multitude of pressure and temperature controls that have an extremely slow actuation thereof, it is to be understood that the various features of this invention can be utilized singly or in any combination thereof to provide an electrical switch construction for other devices as desired.

Therefore, this invention is not to be limited to only the embodiments illustrated in the drawings, because the drawings are merely utilized to illustrate one of the wide variety of uses of this invention.

Figure 2:
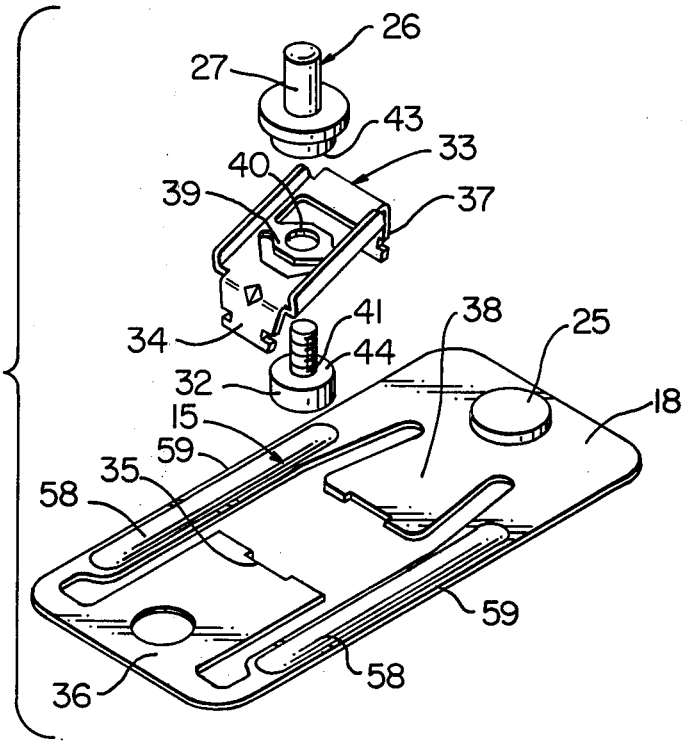
FIG. 2 is a perspective view of the switch blade, actuator spring and actuator plunger of the switch construction of FIG. 1.

Referring now to FIGS. 1 and 2, an electrical switch construction of this invention is generally indicated by the reference numeral 10 and comprises a housing means 11 formed from a first housing part 12 cooperating with a cover housing part 13 to define a chamber 14 therein containing a snap switch blade 15 of this invention adapted to be operated by an actuator means that is generally indicated by the reference numeral 16 to switch a contact carrying portion 18 of the switch blade 15 between a pair of spaced contact stops 19 and 20 respectively electrically interconnected to external terminal means 21 and 22, the switch blade 15 being pivotally mounted to the housing means 11 by its terminal means 23 that is also external to the housing means 11.

In this manner, the terminal 23 is adapted to be electrically interconnected to the terminal 21 of the switch construction 10 when the switch blade portion 18 has its lower contact 24 disposed in electrical contact with the contact 19 as illustrated in FIG. 1. However, when the actuator means 16 is moved in a manner hereinafter described, the switch blade 15 is snapped from the lower contact 19 to the upper contact 20 whereby an upper contact 25 on the contact carrying portion 18 of the blade 15 is placed in electrical contact with the upper contact 20 so that the terminal 23 is now electrically interconnected to the terminal 22.

The actuator means 16 of this invention includes an actuator button or plunger 26 that has a part 27 projecting out of an opening 28 in the cover 13 and being urged to its out position by a return compression spring 29 having one end 30 bearing against the housing part 12 and the other end 31 bearing against a lower part 32 of the plunger 26.

The actuator means 16 also includes an actuator spring 33 that has one leg 34 pivoted to part 35 of a rear portion 36 of the blade 15 and another leg 37 interconnected to a tongue part 38 of the forward portion 18 of the blade 15 as will be apparent hereinafter, the legs 34 and 37 of the actuator spring 32 being compressed toward each other when assembled with the blade 15 into the arrangement illustrated in FIGS. 1 and 2 for a purpose hereinafter described. An intermediate central part 39 of the actuator spring 33 has an opening 40 passing therethrough and receiving a reduced portion 41 of the actuator plunger 26 therethrough whereby the intermediate part 39 of the actuator spring 33 is disposed in a lost motion means or air gap 42 of the actuator plunger 26 that is defined between a pair of opposed shoulders 43 and 44 thereof so that the actuator spring 33 can move relative to the plunger 26 as will be apparent hereinafter.

Figure 3:
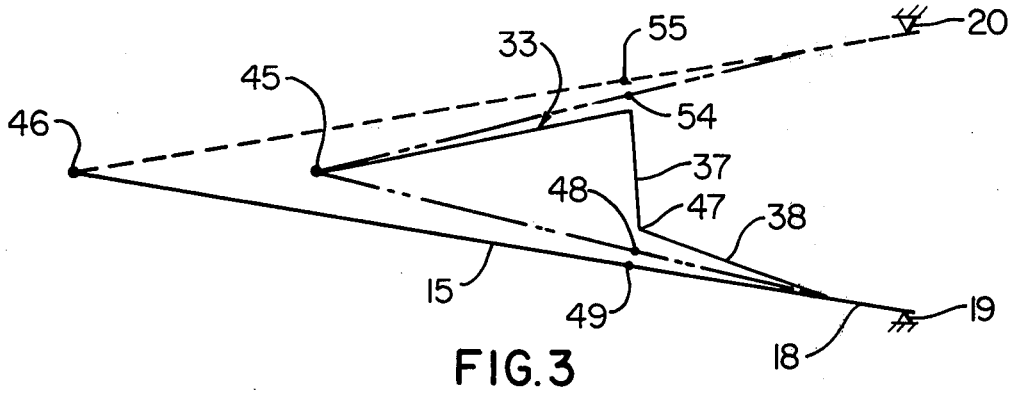
FIG. 3 is a schematic showing of the forces and over center positions of the movable parts of the switch construction of FIG. 1.

As illustrated in FIG. 3, the pivot point for the actuator spring 33 is indicated by the reference numeral 45 while the pivot point for the switch blade 15 is indicated by the reference numeral 46 whereby it can be seen that the pivot points 45 and 46 for the actuator spring 33 and switch blade 15 are disposed in a straight line that bisects the air gap between the normally closed contact stop 19 and the normally open contact stop 20 with the pivot points 45 and 46 being separated from each other for a purpose hereinafter described. The tongue 38 of the switch blade 15 is interconnected to the leg 37 of the actuator spring 33 at the reference numeral 47 in FIG. 3.

When the actuator spring 33 is being moved downwardly about its pivot point 45 in FIG. 3 by the shoulder 43, FIG. 1, of the actuator plunger 26 pushing downwardly on the intermediate part 39 of the actuator spring 33 in opposition to the force of the reset or return spring 29, the point 47 of interconnection of the switch blade tongue 38 and the actuator spring 33 moves downwardly and when the same reaches the point represented by the reference numeral 48, the actuator spring 33 itself snaps over center to cause the stored energy in the spring 33 to move the actuator spring 33 rapidly downwardly relative to the actuator plunger 26 through the air gap or lost motion means 42 thereof and when the point 47 of the actuator spring 33 reaches the point represented by the reference numeral 49 in FIG. 3, the over center position for the switch blade 15 is now reached whereby the blade 15 snaps over center. When the blade 15 snaps over center through the force of the spring 33, the contact portion 18 thereof snaps rapidly upwardly to place the upper contact 25 against the upper normally open contact 20. Thus, it can be seen that when the actuator spring 33 has the point 47 thereof reach the point 48 so that the stored energy of the actuator spring 33 then takes over, the actuator spring 33 still must move the distance between the points 48 and 49 before the switch blade 15 moves over center so that at the time when the point 47 on the actuator spring 33 reaches the over center point 48 for the actuator spring 33, the switch blade 15 is maintaining the lower contact 24 thereof into contact with the fixed lower contact 19 with a sustained contact force at this so-called "trip point" of the switch construction 10.

Figure 9:
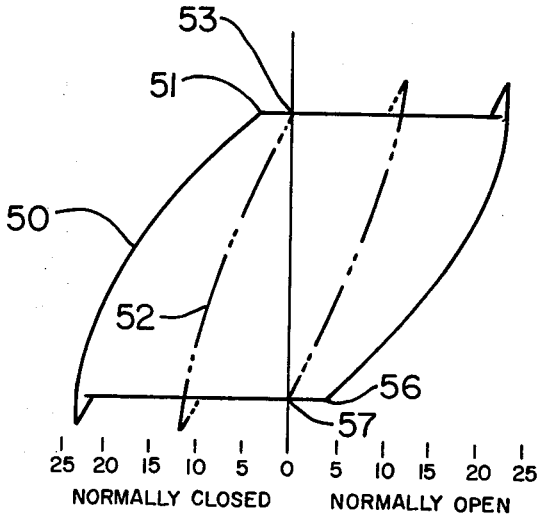
FIG. 9 is a contact force diagram illustrating the contact force of the switch construction of FIG. 1 at time of transfer as compared to conventional double throw electrical switch construction at the time of contact transfer.
Figure 12:
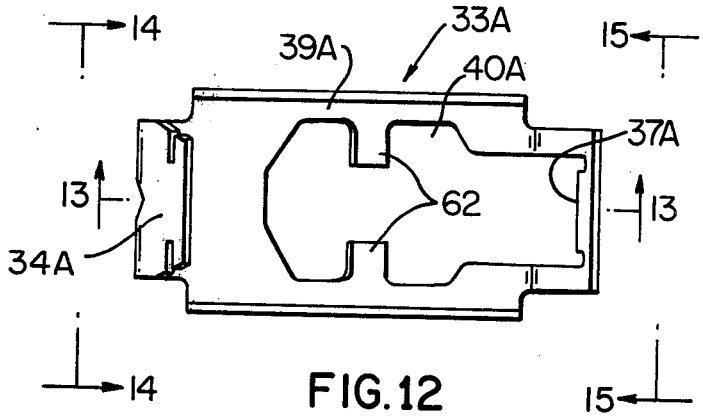
FIG. 12 is an enlarged top view of the actuator spring of the switch construction of FIG. 10.
Figure 13:
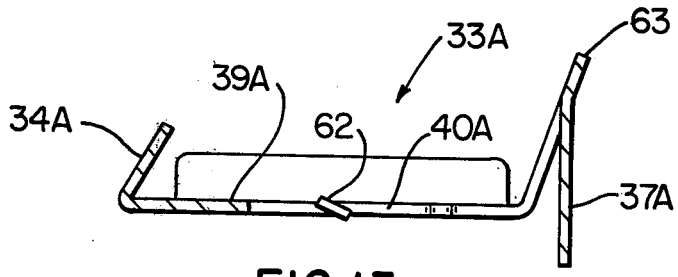
FIG. 13 is a cross-sectional view taken on line 13—13 of FIG. 12.
Figure 14:
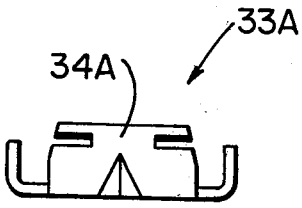
FIG. 14 is an end view of the actuator spring of FIG. 12 and is taken in the direction of the arrows 14—14 of FIG. 12.
Figure 15:
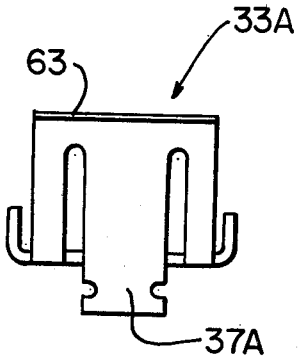
FIG. 15 is an end view of the actuator spring of FIG. 12 and is taken in the direction of the arrows 15—15 of FIG. 12.

As illustrated schematically in the graph of FIG. 9, the force of the lower contact 24 of the switch blade 15 against the lower contact 19 is represented by the line 50 and the point 51 on the line 50 represents the contact force at the "trip point" of the actuator spring 33 so that approximately 5 grams of contact force is being sustained between the switch blade 15 and the lower contact 19 at which time a rapid automatic snap movement of the actuator spring 33 from the point 48 to the point 49 of FIG. 3 takes place before the switch blade 15 is snapped over center and thereby moves the switch blade 15 against the upper contact 20. This is in comparison with conventional electrical switch constructions which have the contact force represented by the dash-dotted lines 52 in FIG. 9 whereby the point 53 represents the contact force at the "trip point" which is substantially a zero contact force.

When the actuator plunger 26 is released so that the force of the return or reset compression spring 29 can move the actuator plunger 26 upwardly, the shoulder 44 comes into contact with the intermediate part 39 of the actuator spring 33 and moves the point 47 of the actuator spring 33 upwardly until the same reaches the point 54 (schematically illustrated in FIG. 3) whereby the actuator spring 33 now goes over center in the opposite direction and snaps upwardly relative to the actuator button 26 through the lost motion means 42 to carry the point 47 to the point 55 whereby the blade 15 is now moved over center so that the blade 15 is snapped from the up position of FIG. 3 back to the down position illustrated in FIG. 3. Thus, it can be seen that a contact force is being sustained at the upper contact 20 at the time the actuator spring 33 moves over center at the point 54 which is the "trip point" of the switch construction and is represented by the point 56 on the line 50 of FIG. 9 in contrast to the zero force point 57 on the line 52 for conventional switch constructions.

In this manner, it can be seen that the distance of the air gap between the shoulders 43 and 44 of the actuator plunger 26 determines the movement differential of the actuator means 16 for causing the switch blade 15 to move between the spaced contact stops 19 and 20.

Therefore, by merely taking the part 41 of the actuator plunger 26 with external threads and threading the same into a threaded bore formed in the upper part 27 of the actuating plunger 26, the air gap or lost motion means 42 can be adjusted to have the shoulders 43 and 44 moved apart a desired distance so that the movement differential of the switch construction 10 of the actuator means 16 can be adjusted without causing any change in the contact forces being sustained at the contacts 19 and 20 as previously described.

In particular, it is well known that the movement differential of the actuator means of prior known switch constructions is accomplished by moving or varying the air gap between the fixed contacts 19 and 20 (which, of course, can also be provided for in the switch construction 10 of this invention). However, the further the fixed contacts are moved from each other, the greater the contact force of the switch blade contacts thereon which, of itself, creates other problems if the force is too great.

Accordingly, it can be seen that by providing an adjustable air gap or lost motion means 42 in the actuator means 16 of this invention, the movement differential of the actuator means 16 can be adjusted without causing an adjustment of the contacts 19 and 20 as in prior known constructions.

Figure 4:
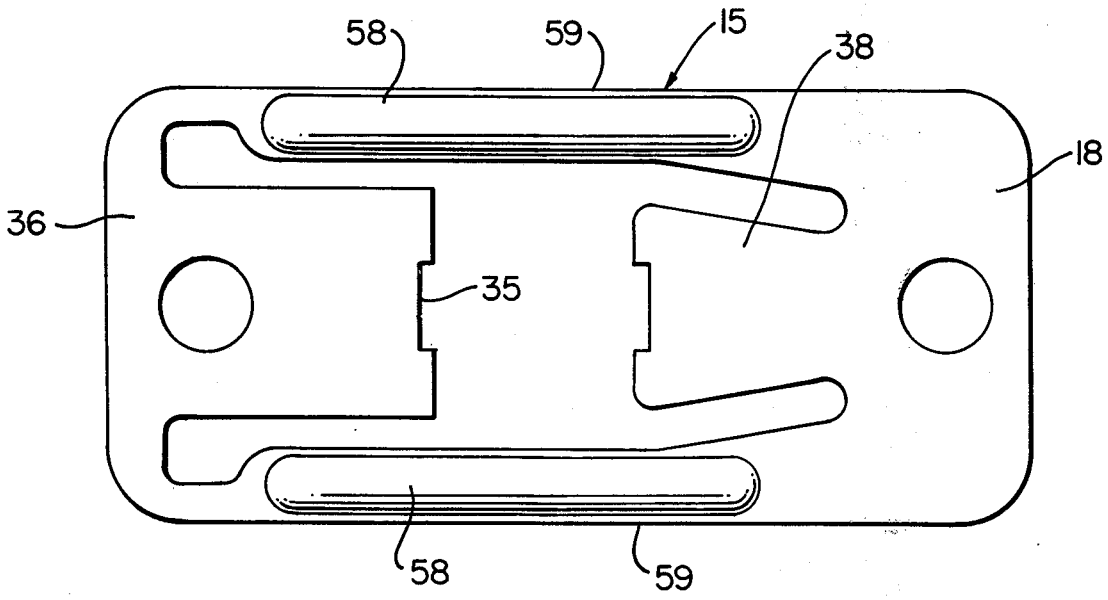
FIG. 4 is a top view of the switch blade of the switch construction of FIG. 1.
Figure 5:
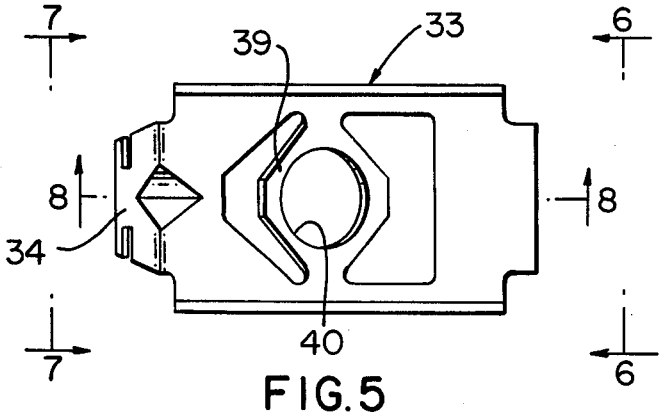
FIG. 5 is a top view of the actuator spring of the switch construction of FIG. 1.
Figure 7:
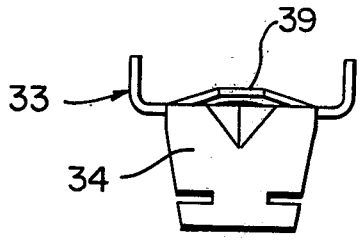
FIG. 7 is an end view of the actuator spring of FIG. 5 and is taken in the direction of the arrow 7—7 of FIG. 5.
Figure 6:
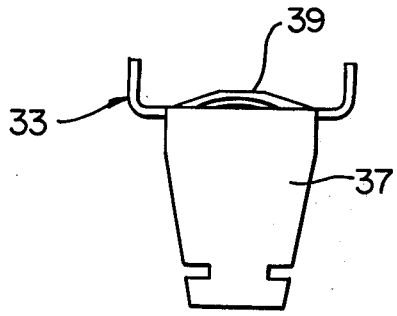
FIG. 6 is an end view of the actuator spring of FIG. 5 and is taken in the direction of the arrow 6—6.
Figure 8:
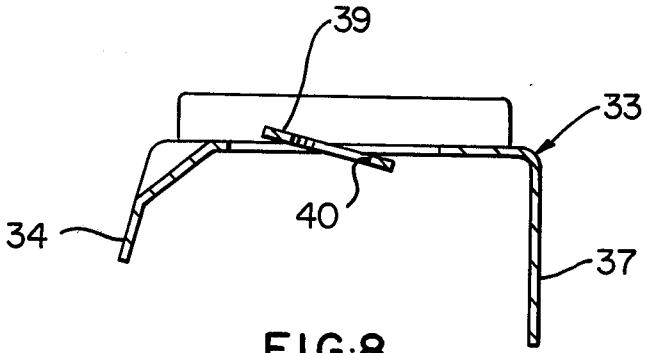
FIG. 8 is a cross-sectional view taken on line 8—8 of FIG. 5.

In order to assure that the switch blade 15 will have the forward portion 18 thereof flexed during the movement of the actuator spring 33, the switch blade 15 is provided with longitudinal embossments 58, FIG. 4, in a pair of integral legs 59 thereof that interconnect the front portion 18 with the rear portion 36 as illustrated. Further, the tongues 36 and 38 are suitably shaped not only for flexibility of the blade 15, but also for attaching to the legs 34 and 37 of the actuator spring 33 as illustrated. Thus, the blade 15 of the switch construction 10 of this invention loses none of the desired contact weld breaking characteristics because the main blade 15 still goes through sufficient bending to mechanically fracture any minute welds which may be formed through normal switch functions.

Thus, it can be seen that the switch construction 10 of this invention can be formed from a relatively few parts to operate in a manner now to be described.

Assuming that the switch construction 10 is in the normally set position of FIG. 1 wherein the movable contact 24 is held against the lower fixed contact 19, a temperature responsive or pressure responsive means can be operating on the plunger 26 so that when the same begins to move the plunger 26 downwardly with a very slow movement thereof, such as 0.0003 of an inch per minute, the point 47 on the actuator spring 33 slowly approaches the point 48 in FIG. 3. Thus, it can be seen that the actuator spring 33 can be "teased" and not be moved over center at the point 48 so that the force of the main blade 15 holding the contact 24 against the fixed contact 19 is with a sustained contact force at this time as represented by the point 51 on the line 50 of the graph of FIG. 9. However, further downward movement of the actuator spring 33 by the plunger 26 moves the point 47 to the point 48 in the schematic showing of FIG. 3 to cause the actuator spring 33 to now snap further downwardly through the lost motion means 42 of the plunger 26 to carry the point 47 to the point 49 and thereby move the tongue 38 of the main blade 15 over center so that the main blade 15 will snap upwardly to place its upper contact 25 into contact with the contact 20.

When the condition responsive means acting on the plunger 26 begins to permit the plunger 26 to move slowly upwardly under the force of the compression spring 29, the actuator spring 33 has its point 47 moved upwardly and when the same reaches the point 54 of the schematic showing of FIG. 3, the blade 33 snaps over center and moves through the lost motion means 42 away from the shoulder 44 of the plunger 26 at a rapid rate to carry the point 47 to the point 55 in FIG. 3 and thereby cause the blade 15 to snap over center and rapidly snap the upper contact 25 away from the upper fixed contact 20 and place the lower contact 24 into contact with the lower contact 19 as illustrated in FIG. 1, the blade 15 maintaining the upper contact 25 in contact with the upper contact 20 with a sustained force as represented by the point 56 of the line 50 of the graph of FIG. 9 up until the switch construction 10 reaches its "trip point" where the point 47 on the actuator spring 33 is at the point 54 on the schematic showing of FIG. 3.

Further, it can be seen that by adjusting the air gap or lost motion means 42 in the plunger 26 of the actuator means 16, the movement differential of the actuator means 16 can be adjusted while the air gap between the fixed contacts 19 and 20 remains the same. Of course, the air gap between the fixed contacts 19 and 20 could be adjusted if desired but by providing the movement differential adjustment means 42 in the plunger 26, the movement differential of the actuator means 16 can be adjusted without changing the contact forces between the blade 15 and the fixed contacts 19 and 20.

Also, with a relatively large gap 42 in the actuator plunger 26, the movement of the actuator spring 33 beyond the snap point of the blade of the main blade 15 could be controlled by providing stops in the chamber 14 to limit the up and down movement of the blade 33 through the lost motion means 42 beyond the snap points or over center points of the main blade 15 as desired.

From the above, it can be seen that the unique design of the switch construction 10 of this invention provides a switch that can sustain contact force right up to contact transfer, even though the switch is activated in a very slow and inconsistent manner. It is believed that the switch construction 10 of this invention has an application in a multitude of pressure and temperature controls all of which present the switch construction 10 with an extremely slow actuation thereof. It is the slow actuation that has brought out a major problem that all existing basic switches appear to have, the problem being that the contact forces that these switches generate diminish quite rapidly to zero before contact transfer occurs. The slower that the prior known switches are actuated, the longer the duration of zero contact force. This causes a condition which is extremely undesirable for both contact and switch life and this condition is a direct function of contact force. This reduced force causes an increase in the resistance offered to current flow and because of this increase, tremendously high localized temperature increases occur. This generates a thermoelectric force which is a phenomenon of the discharge that occurs. The gaseous discharge which is produced will start contact surface melting referred to as chemical melting loss. Therefore, a sustainment of contact force through contact transfers is of utmost importance when considering contact and switch longivity.

All existing basic switches have the same general design, except for the switch construction of the aforementioned co-pending patent application, Ser. No. 557,462, that necessitates that the contact forces go to zero before contact transfer and thereby makes the duration of zero contact force a function of actuation speed. Contact forces after switching varies with different switches, however, all are inherently low and they are especially low at small movement differentials when one considers the vibrations that they might be subjected to and the electrical rating they may meet.

Therefore, it can be seen that the switch construction 10 of this invention matches or lowers the existing basis switch operating force differentials but has contact forces inherently higher and a definite sustained amount of contact force through contact transfer.

It has been found that when the switch construction 10 of this invention is set with a movement differential of 0.003 of an inch, a 0.25 inch separation between the points 45 and 46 of the pivots for the actuator spring 33 and main blade 15 as illustrated in FIG. 3 will cause the actuator spring over center points to occur 0.0005 of an inch before the main blade over center point is reached. This 0.0005 of an inch will enable the switch to sustain approximately 5 grams contact force at a switch "trip point". However, for this principle to function, the actuator spring 33 must have freedom from the actuator button or plunger 26. This freedom is provided in the actuator plunger 26 through a thinned down air gap 42 therein through which the actuator spring 33 can travel. Thus, in the switch construction 10 of this invention the actuator plunger 26 is able to "tease" the actuator spring 33 at its over center point, but is impossible to do so with the main blade 15 and, more important, to the contacts thereof.

Accordingly, with a fixed gap 42 on the actuator plunger 26 it is possible to vary the movement differential of the switch construction 10 by changing the contact air gap as in all other basic switches. However, with the switch construction 10 of this invention, the movement differential can be adjusted by varying the gap 42 in the actuator button 26. If the travel of the actuator spring 33 is limited by stops, substantially higher movement differentials can be sustained without any detrimental rise in contact forces. By using this lost motion method of varying the movement differential, the movement differential is changed directly the same amount as the actuator plunger's gap 42 is altered. Therefore, it is possible to obtain a switch construction 10 whose movement differential can be adjusted through a ratio of 10:1 with no increased contact bounce or no contact force imbalance throughout the entire differential adjustment.

While the switch construction 10 previously described is adapted to be automatically reset back to the condition of FIG. 1 by the reset spring 29 upon a release of force upon the actuator plunger 26 in the manner previously described, it is to be understood that the various features of this invention can be utilized to form a bi-stable, manual reset switch construction, if desired.

For example, another switch construction of this invention is generally indicated by the reference numeral 10A in FIG. 10 and parts thereof similar to the switch construction 10 previously described are indicated by like reference numerals followed by the reference letter "A".

As illustrated in FIG. 10, the switch construction 10A is substantially identical to the switch construction 10 previously described except that the automatic reset spring 29 has been eliminated and a manually actuatable reset spring 60 is provided in place thereof to permit manual resetting of the switch construction 10A back to the condition illustrated in FIG. 10 when a movable reset plunger 61 is pushed upwardly in a manner hereinafter described.

Also, in place of the actuator spring 33 previously described, the switch construction 10A utilizes another actuator spring 33A of this invention that functions in the same manner as the actuator spring 33 previously described as will be apparent hereinafter and, in fact, the actuator spring 33A of FIG. 10 can be utilized in the switch construction 10 in place of the actuator spring 33 thereof, if desired.

As illustrated in FIGS. 11–15, the actuator spring 33A has a pair of angled legs 34A and 37A adapted to respectively be interconnected to the tongues 35A and 38A of the switch blade 15A, as illustrated. An intermediate central part 39A of the actuator spring 33A has an opening 40A passing therethrough and defining a pair of inwardly directed tangs 62 which are received in the adjustable air gap 42A of the actuator plunger 26A that is defined between the pair of opposed shoulders 43A and 44A so that the actuator spring 33A can move relative to the plunger 26A for the reasons previously set forth.

In addition, the top part 63 of the leg 37A of the actuator spring 33A is adapted to abut against the inside surface 64 of the housing means 13A when the actuator spring 33A is in the up condition illustrated in FIG. 10 whereby such abutment of the end 63 of the actuator spring 33A against the housing means 11A forms an upper limit of movement of the actuating plunger 26A relative to the housing means 11A.

The reset plunger 61 for the switch construction 10A of FIG. 10 has an enlarged part 65 disposed within a cylinder defining member 66 of the housing means 11A, the member 66 having a reduced end 67 out through which a button portion 68 of the plunger 61 extends. In this manner, the compression spring 60 has one end 69 bearing against the plunger 61 and the other end 70 thereof bearing against the actuator plunger 26A so that the enlarged part 65 of the reset plunger 61 is normally held against the end 67 of the cylinder defining member 66 that is fixed to the housing means 11A of the switch construction 10A.

In the operation of the switch construction 10A of this invention, when the actuator plunger 26A is pushed downwardly in FIG. 10 to cause the switch blade 15A to snap upwardly from the lower fixed contact 19A to the upper fixed contact 20A in the manner previously described, the plunger 26A does not compress the compression spring 60 sufficiently so that the force of the compression spring 60 can drive the plunger 26A back upwardly because the spring 60 is not as strong as the reset spring 29 for the switch construction 10 previously described.

Thus, the movable contact 25A of the switch blade 15A will remain against the upper contact 20A through the force of the blade 15A and actuator spring 33A opposing the upward force of the spring 60 tending to reset the same until an operator or other suitable structure pushes upwardly on the reset plunger 61 to further compress the spring 60 and thereby force the switch blade 15A to snap downwardly back to the position illustrated in FIG. 10 through the actuator spring 33A in the manner previously described.

Accordingly, it can be seen that the switch construction 10A of this invention operates in substantially the same manner as the switch construction 10 previously described except that in order to reset the switch construction 10A back to the condition of FIG. 10, the reset plunger 61 must be moved manually inwardly relative to the housing means 11A in order to increase the force of the compression spring 60 to return the actuator plunger 26A upwardly in the same manner provided by the spring 29 of the switch construction 10 previously described.

Also, it can be seen that either the actuator spring 33 or 33A can be utilized with the switch construction 10 or 10A, as desired. However, the presently preferred actuator spring for the switch constructions of this invention is the actuator spring 33A illustrated in FIGS. 11-15.

Therefore, it can be seen that this invention not only provides an improved electrical switch construction, but this invention provides a method of making such a switch construction.

While the form and method of this invention have now been described and illustrated as required by the Patent Statute, it is to be understood that other forms and method steps can be utilized and still fall within the scope of the appended claims.

We claim:

1. A method of making an electrical switch construction comprising the steps of forming a housing means to carry a pair of spaced contact stops and a snap switch blade having a contact portion for being snapped between said stops when said blade is moved overcenter, forming a movable actuator means to be carried by said housing means for moving said blade overcenter in one direction when said actuator means is moved in one direction thereof and for moving said blade overcenter in the opposite direction when said actuator means is moved in the opposite direction thereof, forming said actuator means with an adjustable means for adjusting the movement differential of said actuator means without adjusting the air gap between said control stops, forming part of said actuator means with an actuator plunger, forming part of said actuator means with an actuator spring that is moved by movement of said actuator plunger, operatively interconnecting said actuator spring to said blade to move said blade as said actuator spring is moved, and forming said adjustable means of said actuator means with an adjustable gap in said actuator plunger that defines a pair of spaced shoulders on said actuator plunger that are adapted to respectively engage said actuator spring.

2. A method of making an electrical switch construction as set forth in claim 1 and including the step of forming said housing means with a pair of spaced actuator spring stops receiving a portion of said actuator spring therebetween for limiting movement of said actuator spring relative to said housing whereby relatively high movement differentials can be provided for said actuator means without substantially any detremental rise in contact forces.

3. A method of making an electrical switch construction as set forth in claim 1 and including the step of causing said actuator spring to move with a snap movement when moved overcenter by said actuator plunger whereby said actuator spring snaps relative to said plunger through said adjustable gap thereof when said actuator plunger moves said actuator spring overcenter in either direction thereof.

4. A method of making an electrical switch construction as set forth in claim 3 and including the step of causing the overcenter position of said actuator spring to be reached by movement of said actuator plunger before said actuator spring has moved said blade to its overcenter position whereby the resulting snap movement of said actuator spring thereafter causes snap movement of said blade so that a contact force is sustained at the "trip-point" of said switch construction.

5. In a method of making a double throw electrical switch construction having a housing means carrying movable actuator means for moving a snap switch blade of said housing means overcenter to snap a contact portion of said blade between a pair of spaced contact stops carried by said housing means, the improvement comprising the steps of forming part of said actuator means with an actuator plunger and an actuator spring, causing said actuator spring to be movable relative to said housing means and be operatively interconnected to said blade to move said blade as said spring is moved, and forming said plunger with lost motion means for acting against said actuator spring to cause movement thereof as said actuator plunger is being moved whereby said actuator spring can move relative to said actuator plunger through said lost motion means thereof.

6. A method of making a double throw electrical switch construction as set forth in claim 5 and including the step of causing said actuator spring to move with a snap movement when moved overcenter by said actuator plunger whereby said actuator spring snaps relative to said plunger through said lost motion means thereof when said actuator plunger moves said actuator spring overcenter in either direction thereof.

7. A method of making a double throw electrical switch construction as set forth in claim 6 and including the step of causing the overcenter position of said actuator spring to be reached by movement of said actuator plunger before said actuator spring has moved said blade to its overcenter position whereby the resulting snap movement of said actuator spring thereafter causes snap movement of said blade so that a contact force is sustained at the "trip-point" of said switch construction.

8. A method of making a double throw electrical switch construction as set forth in claim 7 and including the step of forming said actuator spring to have a pivot point and said blade to have a pivot point spaced from said pivot point of said actuator spring.

9. A method of making a double throw electrical switch construction as set forth in claim 8 and including the step of causing said pivot points of said spring and blade to be disposed on a straight line that substantially bisects the air gap between said spaced contact stops.

10. In a method of making a double throw electrical switch construction having a housing means carrying movable actuator means for moving a snap switch blade of said housing means overcenter to snap a contact portion of said blade between a pair of spaced contact stops carried by said housing means with a contact force being sustained at the "trip-point" of said switch construction by an actuator spring of said actuator means being moved overcenter before said blade is moved overcenter by the snap movement of said actuator spring, the improvement comprising the step of forming part of said actuator means with an actuator plunger having lost motion means directly acting against said actuator spring whereby said actuator spring can move relative to said actuator plunger through said lost motion means thereof when said actuator plunger moves said actuator spring overcenter in either direction thereof.

11. A method of making a double throw electrical switch construction as set forth in claim 10 and including the steps of forming said actuator spring with a pair of legs interconnected by an intermediate portion, causing said lost motion means to act on said intermediate portion of said actuator spring, and forming said blade with a pair of tongues respectively engaging said legs of said actuator spring.

* * * * *